United States Patent [19]

Nof

[11] Patent Number: 4,597,271

[45] Date of Patent: Jul. 1, 1986

[54] CONTAINER FOR SELF-COOLING THE LIQUID CONTENTS THEREOF

[76] Inventor: Asher Nof, Balfour Street 39, Haifa 33 274, Israel

[21] Appl. No.: 701,784

[22] Filed: Feb. 14, 1985

[51] Int. Cl.[4] ..... F25D 3/10

[52] U.S. Cl. ..... 62/294

[58] Field of Search ..... 62/294; 222/541

[56] References Cited

U.S. PATENT DOCUMENTS

| | | | |
|---|---|---|---|
| 3,309,890 | 3/1967 | Barnett et al. | 62/294 |
| 3,326,013 | 6/1967 | Jacobs | 62/294 |
| 3,636,726 | 1/1972 | Rosenfeld et al. | 62/294 |
| 3,759,060 | 9/1973 | Chase | 62/294 |
| 3,842,617 | 10/1974 | Chase | 62/294 |
| 3,919,856 | 11/1975 | Beck | 62/294 |
| 3,987,643 | 10/1976 | Willis | 62/294 X |

*Primary Examiner*—Lloyd L. King

*Attorney, Agent, or Firm*—Benjamin J. Barish

[57] ABSTRACT

A container for self-cooling the liquid contents of the container comprises a cartridge for a pressurized refrigerant gas, and a conduit leading from the cartridge to a gas discharge port on the container and passing through the interior of the container to cool its liquid contents when the gas is discharged to the atmosphere via the port. The container further includes a valve normally closed but manually openable to initiate a rapid discharge of the gas via the conduit and thereby to cool the liquid contents of the container.

11 Claims, 2 Drawing Figures

CONTAINER FOR SELF-COOLING THE LIQUID CONTENTS THEREOF

BACKGROUND OF THE INVENTION

The present invention relates to containers for liquids, such as beverages, and particularly to a container which self-cools its liquid contents.

Beverages are commonly cooled before being consumed. Normally this is done by cooling the beverage in a refrigerator, in an ice pack, or by adding ice cubes. However, there are many places where refrigeration or ice is not conveniently available, for example at picnics, outside sport activities, and the like.

An object of the present invention is to provide a container which itself self-cools its liquid contents and therefore does not require separate refrigeration or ice.

BRIEF SUMMARY OF THE INVENTION

According to a broad aspect of the present invention, there is provided a container for self-cooling its liquid contents, characterized in that the container includes a cartridge for a pressurized refrigerant gas, a gas discharge port leading from the interior of the container to the atmosphere, and conduit means leading from the cartridge to the gas discharge port and passing through the interior of the container to cool the liquid contents thereof when the gas is discharged to the atmosphere via the latter port. The container further includes valve means normally closed but manually openable to initiate a rapid discharge of the gas to the atmosphere from the cartridge via the conduit means and the gas discharge port, to thereby cool the liquid contents of the container.

According to an important preferred feature of the invention, the conduit means has a length many times that of the container, and is formed with a plurality of loops providing a large surface area for cooling the liquid contents of the container. Preferably, the conduit means is in the form of a spirally-wound coil occupying a substantial volume of the container.

According to another important feature included in the preferred embodiments of the invention described below, the conduit means includes a first section at the end thereof connected to the cartridge, and a second section at the opposite end connected to the gas discharge port on the container, the first section being of smaller diameter than the second section. In addition, the valve means is disposed at the juncture of the first and second sections of the conduit means.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
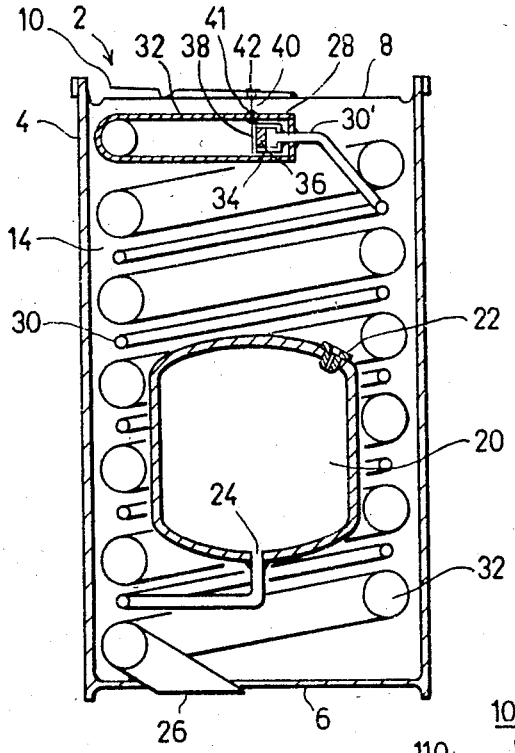
FIG. 1 diagramatically illustrates the structure of one form of self-cooling container constructed in accordance with the present invention.

The container illustrated in FIG. 1, and therein generally designated 2, is of the metal type commonly used for packaging and selling carbonated beverages. It includes a cylindrical side wall 4 closed by a metal bottom wall 6 and a metal top wall 8. A pull-tab 10 is fixed at 12 to the container top wall 8 for opening the top wall by either tearing out a portion thereof or tearing out the complete wall. The interior 14 of the container is filled with the beverage, under pressure if the beverage is carbonated, and may be poured out of the container when its top wall 8 is opened by pull-tab 10.

Such containers, insofar as described above, are in common use, and therefore further details of their construction are not necessary. As briefly described above, if the contents of the container are to be cooled, this is usually done by placing the container in a refrigerator or in an ice pack, or by adding ice to the beverage after it has been poured out of its container.

According to the present invention, container 2 in FIG. 1 is provided with means for self-cooling its liquid contents without the need of external refrigeration or ice. For this purpose, the container is provided with a cartridge 20 adapted to be filled with a pressurized refrigerant gas via the cartridge inlet 22. Cartridge 20 is formed with an outlet 24 connected to a conduit arrangement, to be more particularly described below, leading to a gas discharge port 26 passing through the bottom wall 6 of the container. The above mentioned conduit also includes valve means, generally designated 28 and also to be described below, which is normally closed but is manually openable to initiate a rapid discharge of the gas to the atmosphere from cartridge 20 via the conduit means and discharge port 26, to thereby cool the liquid contents of the container.

The conduit means disposed within container 2 includes two sections, namely a first section 30 at the end thereof connected to outlet 24 of cartridge 20, and a second section 32 at the end thereof connected to the discharge port 26. The two sections are separated by the above-mentioned valve means 28.

As can be seen in FIG. 1, conduit section 30 is in the form of a small-diameter coil having a plurality of loops extending substantially the complete length of the interior of the container from the outlet end of cartridge 20 adjacent to the container bottom wall 6, to the valve means 28 adjacent to the container top wall 8. Section 32 of the conduit is a larger diameter coil also having a plurality of loops extending substantially the complete length of the container, from the valve means 28 adjacent to the container top wall 8, to the discharge port 26 passing through the container bottom wall 6.

Valve 28 is located at the juncture at the small diameter conduit 30 with the large diameter conduit 32. This valve includes a cylinder 34 disposed within end 32′ of the large diameter conduit 32, and a piston 36 movable within the cylinder. The inlet end of cylinder 34 communicates with end 30′ of the small diameter conduit 30, and the outlet end of the cylinder communicates with end 32′ of the large diameter conduit 32.

Piston 36 is normally retained in its closed position, illustrated in FIG. 1, by a stop 38, to prevent the gas flow from conduit 30 leading from cartridge 20, to conduit 32 leading to the discharge port 26. Stop 38 is secured to a pull-wire 40, which passes through a sealed lead-in and is secured at 42 to the pull-tab 10 at the top of the container. Tab 10 may thus be pulled to remove stop 38 from cylinder 34, whereupon piston 36 will move out of cylinder 34 by the pressure within cartridge 20 communicated to cylinder 34 by the small diameter conduit 30, to thereby establish gas flow from cartridge 20 through outlet port 26 via the two conduit sections 30 and 32.

Figure 2:
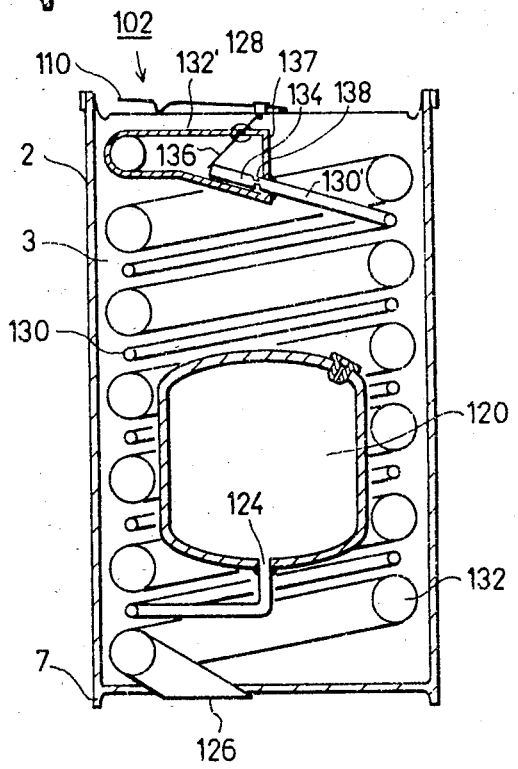
FIG. 2 diagrammatically illustrates a second structure of a self-cooling container constructed in accordance with the present invention.

The container illustrated in FIG. 2 is used in the following manner:

Cartridge 20 is filled with a refrigerant gas, under pressure, via its inlet 22 and while stop 38 of valve 28 is in position to retain piston 36 in its closed condition, as illustrated in FIG. 1. The container is then filled from its bottom (i.e. while the container is in an inverted position) with the liquid contents, and then the bottom wall 6 is applied.

When it is desired to open the container in order to pour out the liquid contents, pull-tab 10 is pulled which opens the container top wall 8, either by removing a weakened portion thereof or removing the complete top wall, as known in this type of container. At the same time the top wall is opened, stop 38, by virtue of its connection 40 with the top wall, is removed from cylinder 34 of valve 28. The pressure from cartridge 20, communicated to piston 36 via the small diameter conduit 30, ejects the piston from cylinder 34, thereby opening valve 28 and establishing communication from cartridge 20 to the atmosphere via small diameter conduit 30, valve 28, large diameter conduit 32 and discharge port 26. A rapid discharge of the pressurized gas within cartridge 20 is thus produced through conduits 30 and 32 to quickly cool the contents of the container.

In the above described arrangement, the conduit sections 30 and 32 have a length many times that of the container and are formed with a plurality of loops extending substantially the complete length of the container, and therefore provide a large surface area for rapidly cooling the contents of the container. Forming the conduit with two sections, namely a small diameter section adjacent the refrigerant cartridge 20 and a large diameter section adjacent the discharge port 26, provides an efficient and uniform heat transfer between the expanding gas within the conduit sections and the liquid in contact with them.

Many refrigerant gases are known and may be used. For example, solvents, such as 1,2,2 trichloro 1,2,2 trifluoroethane and sold under the trademark "Arklone" P, L, A, K, W, E, F and AM, and widely used for cleaning electronic components and cold flushing pipelines and valve assemblies, have been found very effective. The container including the cartridge is preferably of the refillable type, the cartridge being refilled after its use; but it is contemplated that the container could also be for one-time use.

FIG. 2 illustrates a container, therein designated 102, having a construction similar to that of FIG. 1, but including a different valve arrangement, therein designated 128.

Thus, the container 102 of FIG. 2 also includes a cartridge 120 for a pressurized refrigerant gas, and a conduit constituted of a small diameter section 130 and a large diameter section 132 connected between the outlet 124 of cartridge 120 and the gas discharge port 126 leading to the atmosphere. In addition, valve 128 is also interposed between the two conduit sections 130, 132.

Valve 128 in FIG. 2 is of a different construction from the cylinder and piston arrangement illustrated in FIG. 1. Thus, valve 128 is constituted of an extension 134 of end 130' of the small-diameter conduit 130, which extension is closed by an end plug 136. End 130' passes through a wall 137 in end 132' of the large-diameter conduit section 132. A portion of extension 134 disposed within end 132' of the large-diameter conduit section is formed with a weakened portion 138, and is connected by wire 128 to the pull-tab 110, so that pulling the tab, in the same manner as described above with respect to the FIG. 1 embodiment, severes extension 134 along its weakened line 138, and thereby establishes communication between conduits 130 and 132.

In all other respects, the container illustrated in FIG. 2 is constructed as, and operates in the same manner as, the container illustrated in FIG. 1.

While the invention has been described with respect to two preferred embodiments, it will be appreciated that many other variations, modifications and applications of the invention may be made.

What is claimed is:

1. A container for self-cooling the liquid contents thereof, characterized in that said container includes:

a cartridge for a pressurized refrigerant gas;

a gas discharge port leading from the interior of the container to the atmosphere;

conduit means leading from said cartridge to said gas discharge port and passing through the interior of the container to cool the liquid contents thereof when the gas is discharged to the atmosphere via said port, said conduit means having a length many times that of the container and is being formed with a plurality of loops providing a large surface area for cooling the liquid contents of the container, said conduit means including a first section at the end thereof connected to said cartridge, and a second section at the end thereof connected to said gas discharge port, said first section being of smaller diameter than said second section; and valve means disposed at the juncture of said first and second sections of said conduit means, said valve means being normally closed but manually openable to initiate a rapid discharge of the gas to the atmosphere from said cartridge via said conduit means and said gas discharge port, to thereby cool the liquid contents of the container.

2. The container according to claim 1, wherein said conduit means is in the form of a spirally-wound coil occupying a substantial volume of the container.

3. The container according to claim 1, wherein said valve means comprises:

a cylinder within said conduit means;

a piston movable within said cylinder either to a closed position or to an open position;

and a stop normally retaining said piston in its closed position to block the gas flow through said conduit means, but manually movable to release said piston for movement to its opened position by the gas pressure within the cartridge.

4. The container according to claim 1, wherein said valve means comprises: a section of said conduit means which is normally closed to block the gas flow through said conduit means, but which is weakened to permit manual removal thereof to permit the gas flow through said conduit means.

5. The container according to claim 1, wherein said valve means is manually openable by means of a pull-wire passing through the container wall for pulling by the user.

6. The container according to claim 5, wherein said pull-wire is secured to a pull-tab mounted to the top wall of the container.

7. The container according to claim 6, wherein said container is of metal and includes a metal top wall which has a weakened tear portion secured to said pull-tab for removing same at the time said pull-tab pulls said wire to open said valve means.

8. A container for self-cooling the liquid contents thereof, characterized in that said container includes:

a cartridge for a pressurized refrigerant gas;

a gas discharge port leading from the interior of the container to the atmosphere;

conduit means leading from said cartridge to said gas discharge port and passing through the interior of the container to cool the liquid contents thereof when the gas is discharged to the atmosphere via said port; and valve means normally closed but manually openable to initiate a rapid discharge of the gas to the atmosphere from said cartridge via said conduit means and said gas discharge port, to thereby cool the liquid contents of the container said valve means comprising: a cylinder within said conduit means; a piston movable within said cylinder either to a closed position or to an open position; and a stop normally retaining said piston in its closed position to block the gas flow through said conduit means, but manually movable to release said piston for movement to its position opened by the gas pressure within the cartridge.

9. The container according to claim 8, wherein said conduit means has a length many times that of the container and is formed with a plurality of loops providing a large surface area for cooling the liquid contents of the container.

10. The container according to claim 9, wherein said conduit means includes a first section at the end thereof connected to said cartridge, and a second section at the end thereof connected to said gas discharge port, said first section being of smaller diameter than said second section.

11. The container according to claim 10, wherein said valve means is disposed at the juncture of said first and second sections of said conduit means.

* * * * *